US010040596B2

(12) United States Patent
Leite

(10) Patent No.: US 10,040,596 B2
(45) Date of Patent: Aug. 7, 2018

(54) CARTON AND CARTON BLANK

(71) Applicant: Westrock Packaging Systems, LLC, Norcross, GA (US)

(72) Inventor: Bruno M. Leite, Sao Paulo (BR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/300,517

(22) PCT Filed: Apr. 30, 2015

(86) PCT No.: PCT/US2015/028557
§ 371 (c)(1),
(2) Date: Sep. 29, 2016

(87) PCT Pub. No.: WO2015/171426
PCT Pub. Date: Nov. 12, 2015

(65) Prior Publication Data

US 2017/0174388 A1 Jun. 22, 2017

Related U.S. Application Data

(60) Provisional application No. 61/990,555, filed on May 8, 2014.

(51) Int. Cl.
*B65D 5/46* (2006.01)
*B65D 71/36* (2006.01)
(Continued)

(52) U.S. Cl.
CPC ..... *B65D 5/46192* (2013.01); *B65D 5/10* (2013.01); *B65D 5/4266* (2013.01); *B65D 71/36* (2013.01);
(Continued)

(58) Field of Classification Search
CPC ..... B65D 5/10; B65D 5/42; B65D 5/4266; B65D 5/46; B65D 5/46096;
(Continued)

(56) References Cited

U.S. PATENT DOCUMENTS 5,480,091 A 1/1996 Stout
5,738,273 A 4/1998 Auclair
(Continued)

FOREIGN PATENT DOCUMENTS

EP 1105314 B1 11/2004
EP 1326788 B1 5/2005
(Continued)

*Primary Examiner* — Bryon Gehman
(74) *Attorney, Agent, or Firm* — WestRock Intellectual Property Group

(57) ABSTRACT

A handle structure (H) for a carton having a handle panel (12, 20) includes a strap member integrally conjoined with the handle panel and extending substantially between the opposing end edges (21*a*, 21*c*, 29*a*, 29*c*) of the handle panel. The strap member has opposing strap edges substantially disjoined from the handle panel and includes a substantially centrally disposed grip region (HI, H2). A severance line segment (65*a*, 67*a*) is disposed proximate each corner of the handle panel and extends from a first end point proximate that corner to a second end point proximate the grip region such that when force (F) normal to the plane of the handle panel is exerted upon the grip region, the strap member is flexed substantially outwardly of the plane to a biased position above the plane. The handle structure further includes a pair of first and second fold lines (79*a*, 77*a*) extending from each severance line segment and converging towards the adjacent corner of the handle panel.

18 Claims, 6 Drawing Sheets

(51) Int. Cl.
*B65D 5/42* (2006.01)
*B65D 5/10* (2006.01)

(52) U.S. Cl.
CPC ..... *B65D 2571/00141* (2013.01); *B65D 2571/00462* (2013.01); *B65D 2571/00728* (2013.01)

(58) Field of Classification Search
CPC .... B65D 5/46192; B65D 5/542; B65D 71/36; B65D 2571/00141; B65D 2571/00462; B65D 2571/00728
USPC ..... 206/427; 229/117.12, 117.13, 117.14
See application file for complete search history.

(56) References Cited

U.S. PATENT DOCUMENTS 6,129,266 A * 10/2000 Oliff ..... B65D 71/36 229/117.12
6,131,803 A 10/2000 Oliff
6,260,755 B1 7/2001 Bates
8,955,736 B2 * 2/2015 Spivey, Sr. ..... B65D 5/46096 229/117.12
9,033,209 B2 * 5/2015 Fogle ..... B65D 5/46192 229/117.12

FOREIGN PATENT DOCUMENTS

EP 1381545 B1 10/2005
WO WO 2011059529 A1 * 5/2011

* cited by examiner

CARTON AND CARTON BLANK

TECHNICAL FIELD

The present invention relates to a carton and to a blank for forming the carton more specifically, but not exclusively, to a carton having a handle structure for carrying the carton.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide a carton with a carrying handle which is robust and readily accessed.

The present invention seeks to overcome or at least mitigate the problems of the prior art.

SUMMARY

According to a first aspect of the present invention, there is provided a carton including a handle panel and a first corner panel. The handle panel has first and second opposing end edges and opposing side edges which intersect each other to form corners of the handle panel. The first corner panel is hinged to the handle panel at the first end edge. The handle panel includes a handle structure for carrying the carton. The handle structure includes a strap member integrally conjoined with the handle panel and extending substantially between the end edges of the handle panel. The strap member has opposing strap edges substantially disjoined from the handle panel. The strap member includes a substantially centrally disposed grip region. The handle structure further includes a severance line segment disposed proximate each corner of the handle panel and extending from a first end point proximate that corner to a second end point proximate the grip region of the strap member. The carton further include a first cutaway separating the first corner panel from a first one of the corners of the handle panel, and a second cutaway separating the first corner panel from a second one of the corners of the handle panel, such that when a force substantially normal to a plane of the handle panel is exerted upon the grip region, the first and second cutaways facilitate displacement of the first corner panel towards the first end edge of the handle panel whereby the strap member is encouraged to flex substantially outwardly of the plane to a biased position above the plane.

Optionally, the carton may further includes a second corner panel hinged to the handle panel at the second end edge, a third cutaway separating the second corner panel from a third one of the corners of the handle panel, and a fourth cutaway separating the second corner panel from a fourth one of the corners of the handle panel, such that when a force substantially normal to the plane of the handle panel is exerted upon the grip region, the third and fourth cutaways facilitate displacement of the second corner panel towards the second end edge of the handle panel whereby the strap member is encouraged to flex substantially outwardly of the plane to said biased position.

Optionally, the grip region may be defined at least in part by respective segments of the opposing strap edges of the strap member, the respective segments being substantially parallel to the opposing side edges of the handle panel.

Optionally, the handle structure may further include a pair of first and second fold lines extending from each severance line segment and converging towards the adjacent corner of the handle panel.

Optionally, the carton may further comprise a first trapezoidal portion disposed adjacent to each corner of the handle panel. Each first trapezoidal portion may be defined in part by the respective pair of first and second fold lines.

Optionally, each first trapezoidal portion may be defined in part by the respective one of the first, second, third and fourth cutaways.

Optionally, an end edge of each first trapezoidal portions is defined by the respective one of the first, second, third and fourth cutaways.

Optionally, the carton may further include a second trapezoidal portion disposed between each severance line segment and the adjacent side edge of the handle panel. Each second trapezoidal portion may be disposed adjacent to the respective first trapezoidal portion and may be defined in part by a third fold line and the second fold line of the respective the first trapezoidal portion. The third and second fold lines of each second portion may extend divergently towards the adjacent side edge of the handle panel.

Optionally, the carton may further include a triangular portion disposed adjacent to each second trapezoidal portion. Each triangular portion may be defined in part by a fourth fold line and the third fold line of the respective second trapezoidal portion. The third and fourth fold lines of each triangular portion may extend divergently toward the adjacent side edge of the handle panel. The fourth fold line of each triangular portion may terminate on the third fold line of that triangular portion.

According to a second aspect of the present invention, there is provided a blank for forming a carton. The blank includes a plurality of panels for forming walls of the carton. The blank further includes a handle panel and a first corner panel. The handle panel forms one of the walls of the carton. The handle panel has first and second opposing end edges and opposing side edges that intersect to form corners of the handle panel. The first corner panel is hinged to the handle panel at the first end edge. The handle panel includes a handle structure for carrying the carton in a set up condition. The handle structure includes a strap member integrally conjoined with the handle panel and extending substantially between the end edges. The strap member has opposing strap edges substantially disjoined from the handle panel. The strap member includes a substantially centrally disposed grip region. The handle structure further includes a severance line segment disposed proximate each corner of the handle panel and extending from a first end point proximate the respective corner to a second end point proximate the grip region of the strap member. The blank further includes a first cutaway separating the first corner panel from a first one of the corners of the handle panel; and a second cutaway separating the first corner panel from a second one of the corners of the handle panel, such that in a set up carton when a force is exerted upon the grip region substantially normally to a plane of the handle panels, the first and second cutaways facilitate displacement of the first corner panel towards the first end edge of the handle panel to encourage the strap member to flex substantially outwardly of the plane to a biased position above the plane.

Optionally, the blank may further include a second corner panel hinged to the handle panel at the second end edge, a third cutaway separating the second corner panel from a third one of the corners of the handle panel, and a fourth cutaway separating the second corner panel from a fourth one of the corners of the handle panel, such that in a set up condition when a force substantially normal to the plane of the handle panel is exerted upon the grip region, the third and fourth cutaways facilitate displacement of the second corner panel towards the second end edge of the handle panel whereby the strap member is encouraged to flex substantially outwardly of the plane.

Optionally, each of the first, second, third and fourth cutaways is formed by an aperture.

Optionally, each aperture is defined in part by the handle panel, the respective corner panel, a side panel hinged to the handle panel, a minor end closure panel hinged to the corner panel and a web panel coupling the minor end closure panel to a major end closure panel hinged to the side panel.

According to a third aspect of the present invention, there is provided a handle structure for a carton. The carton has a handle panel with opposing side edges and opposing end edges that intersect to form corners of the handle panel. The handle structure includes a strap member integrally conjoined with the handle panel and extending substantially between the end edges. The strap member has opposing strap edges substantially disjoined from the handle panel. The strap member includes a substantially centrally disposed grip region, and a severance line segment disposed proximate each corner of the handle panel and extending from a first end point proximate that corner to a second end point proximate the grip region of the strap member, such that when a force substantially normal to a plane of the handle panel is exerted upon the grip region, the strap member is flexed substantially outwardly of the plane to a biased position above the plane. The handle structure further includes a pair of first and second fold lines extending from each severance line segment and converging toward the adjacent corner of the handle panel.

Optionally, the grip region may be defined at least in part by respective segments of the opposing strap edges of the strap member, the respective segments being substantially parallel to the opposing side edges of the handle panel.

Optionally, the handle structure may further include a first trapezoidal portion disposed adjacent to each corner of the handle panel. Each first trapezoidal portion may be defined in part by the respective pair of first and second fold lines.

Optionally, the first fold line of each pair of first and second fold lines may extend from the outer end of the respective severance line segment to a point on the adjacent end edge of the handle panel laterally inset from the adjacent side edge of the handle panel.

Optionally, the second fold line of each pair of first and second fold lines may extend from the adjacent corner of the handle panel to a location on the adjacent severance line segment inset from the outer end of the adjacent severance line segment.

Optionally, the handle structure may further include a second trapezoidal portion disposed between each severance line segments and the adjacent side edge of the handle panel. Each second trapezoidal portion may be disposed adjacent to the respective first trapezoidal portion and may be defined in part by a third fold line and the second fold line of the respective first trapezoidal portion. The third and second fold lines of each second portion may extend divergently towards the adjacent side edge of the handle panel.

Optionally, the handle structure may further comprise a triangular portion disposed adjacent to each second trapezoidal portion. Each triangular portion may be defined in part by a fourth fold line and the third fold line of the respective second trapezoidal portion. The third and fourth fold lines of each triangular portion may extend divergently towards the adjacent side edge of the handle panel. The fourth fold line of each triangular portion may terminate on the third fold line of that triangular portion.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
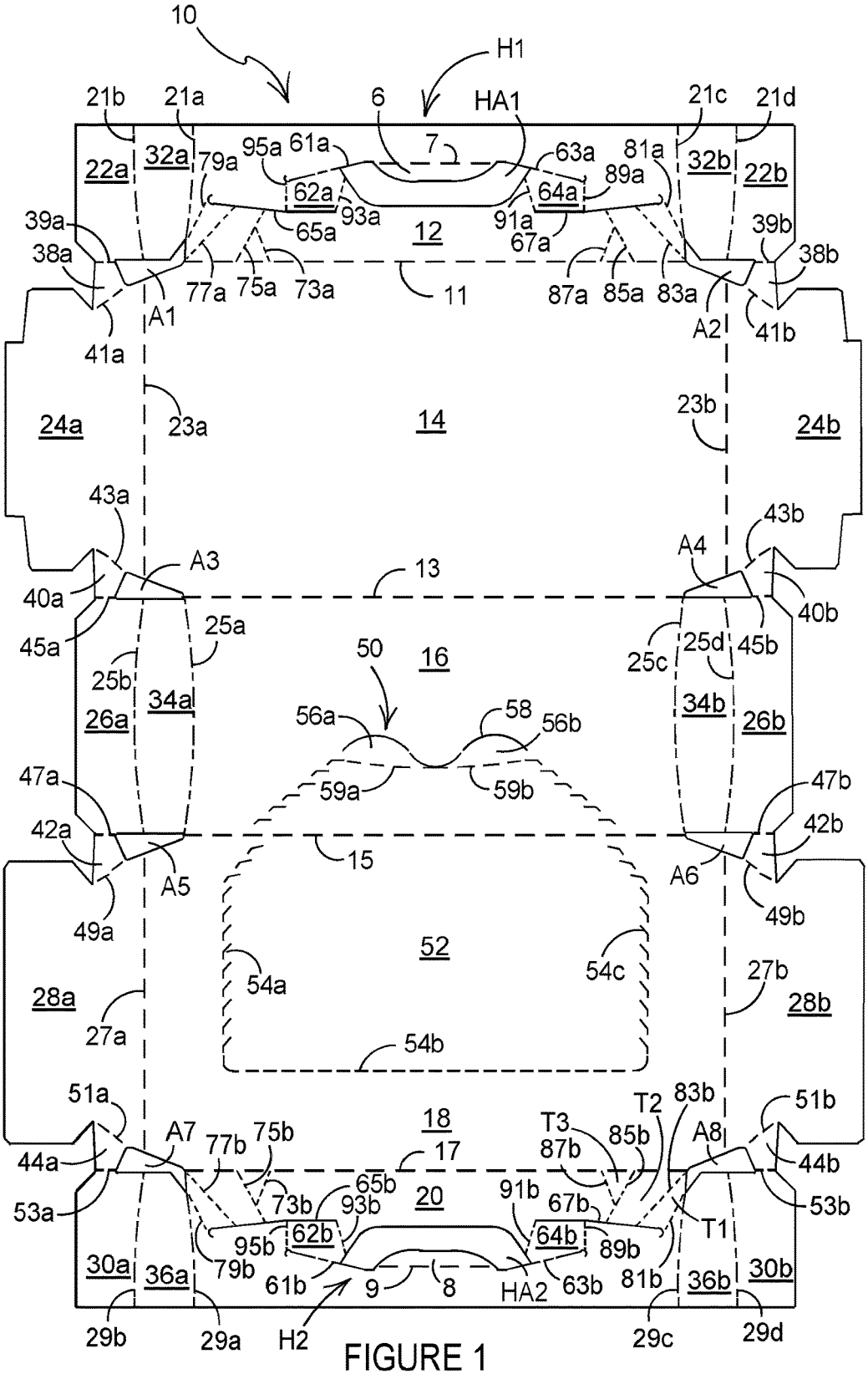
FIG. 1 is a plan view from above of a blank for forming a carton according to a first embodiment.

FIG. 1 shows a plan view of a first blank 10 capable of forming a carton 90, as shown in FIGS. 2 to 6, for primary products such as, but not limited to, cans, hereinafter referred to as articles C. FIGS. 2 to 6 illustrate a carton 90 having a handle structure in accordance with a preferred embodiment of the invention.

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiment, the blanks are configured to form a carton or carrier for packaging an exemplary arrangement of exemplary articles. In a first illustrated exemplary embodiment, the arrangement is a 3×5 matrix or array and the articles are cans. The blank can be alternatively configured to form a carrier for packaging other types, number and size of article and/or for packaging articles in a different arrangement or configuration.

Figure 2:
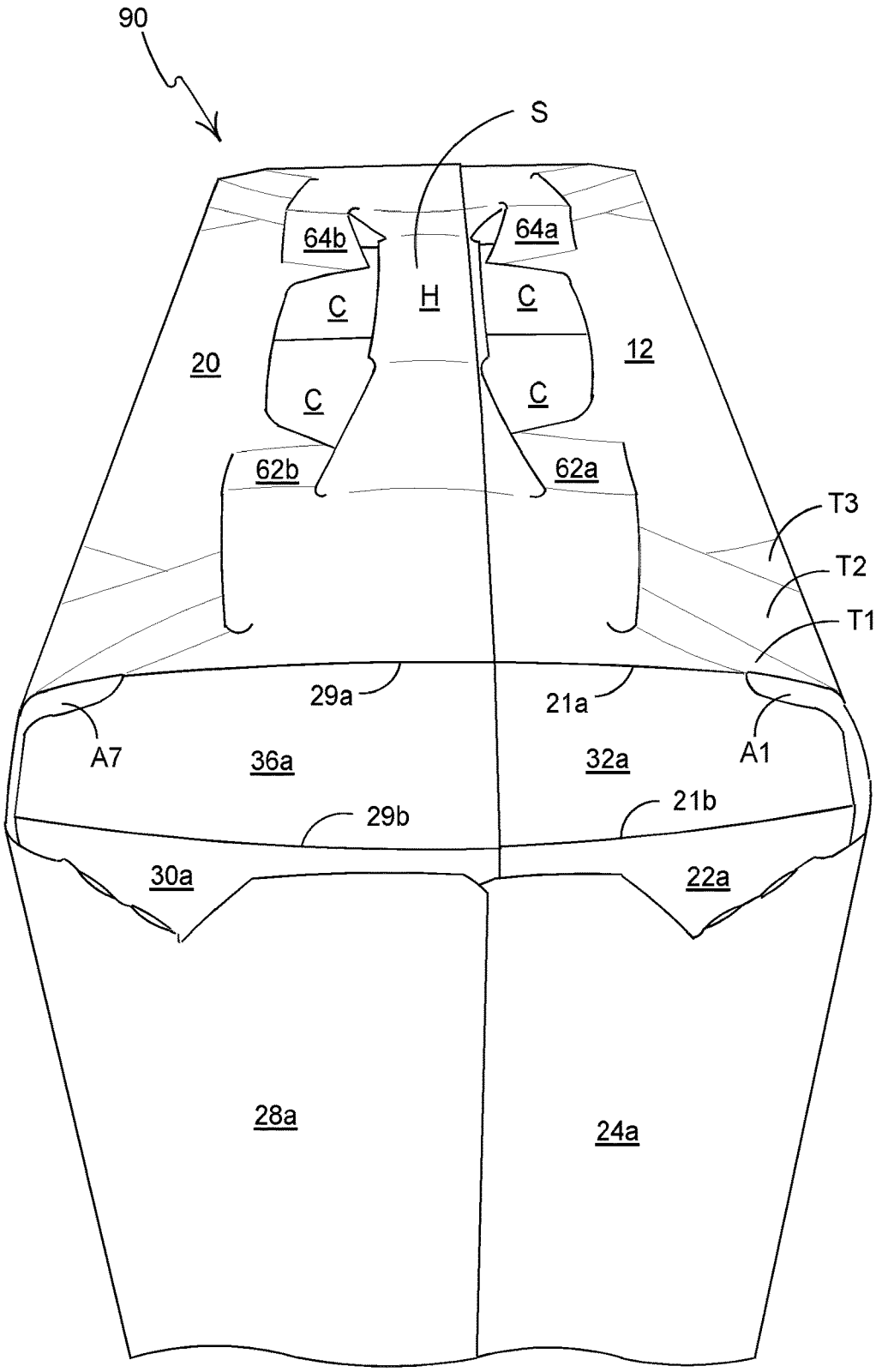
FIG. 2 is a perspective view from above of a carton formed from the blank of FIG. 1.
Figure 3:
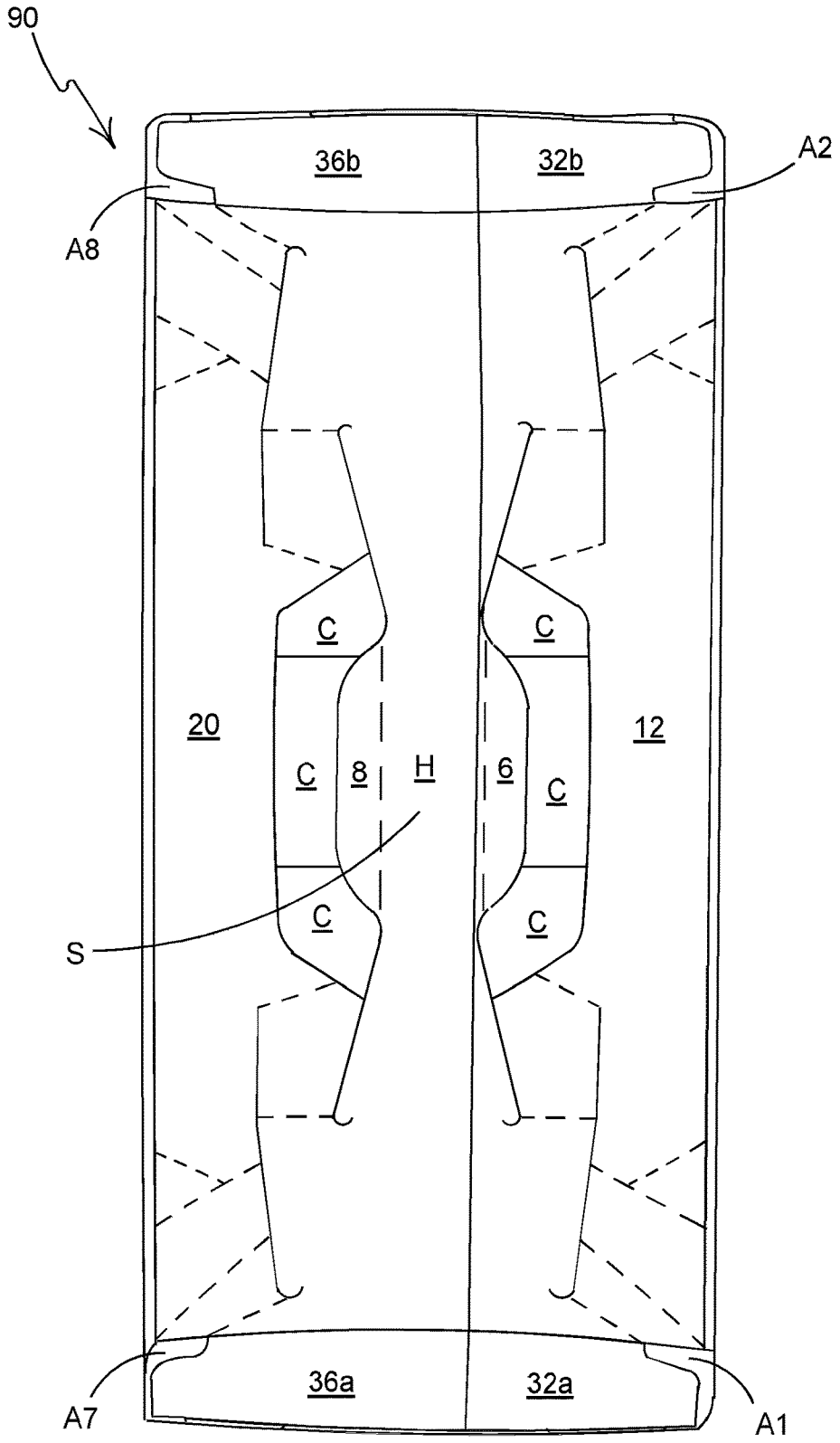
FIG. 3 is a plan view from above of the carton formed from the blank of FIG. 1.
Figure 4:
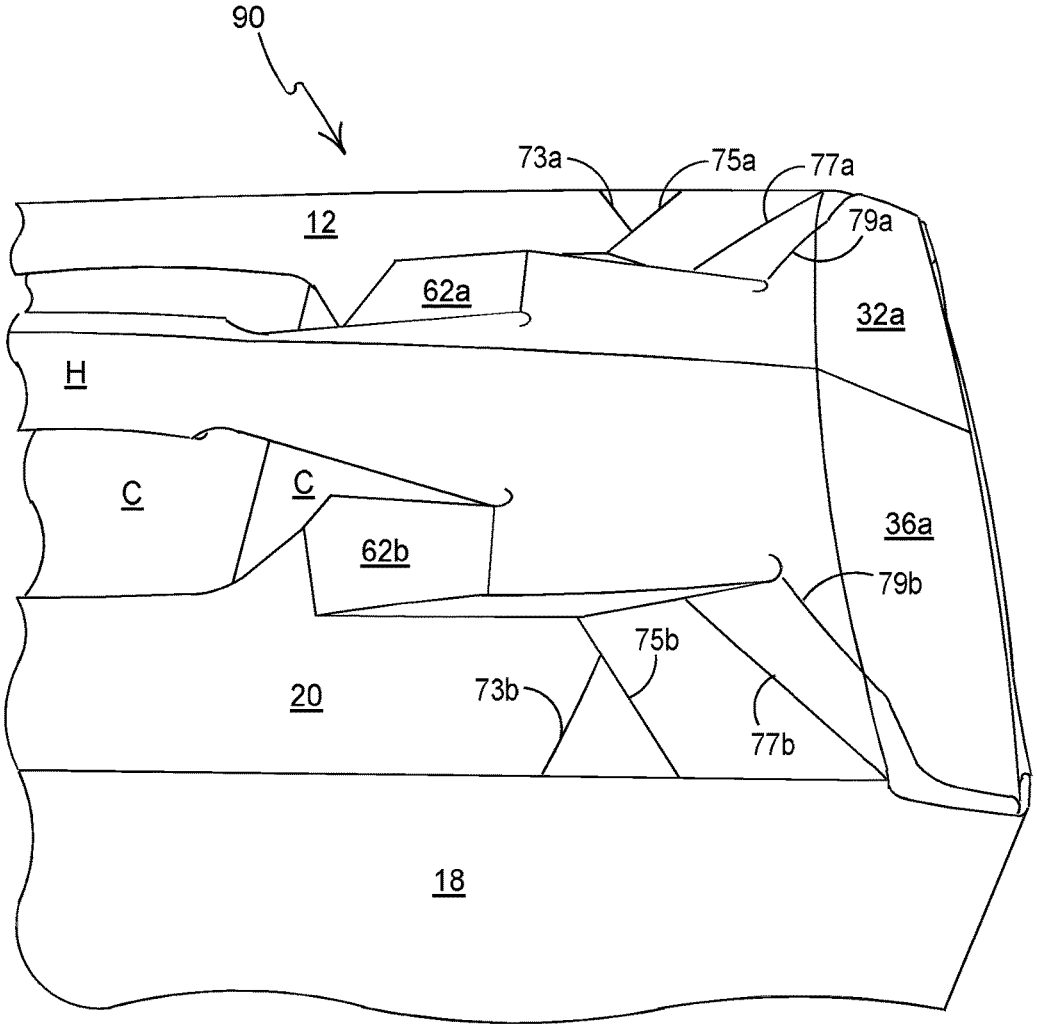
FIG. 4 is perspective view of an end of a carton formed from the blank of FIG. 1.
Figure 5:
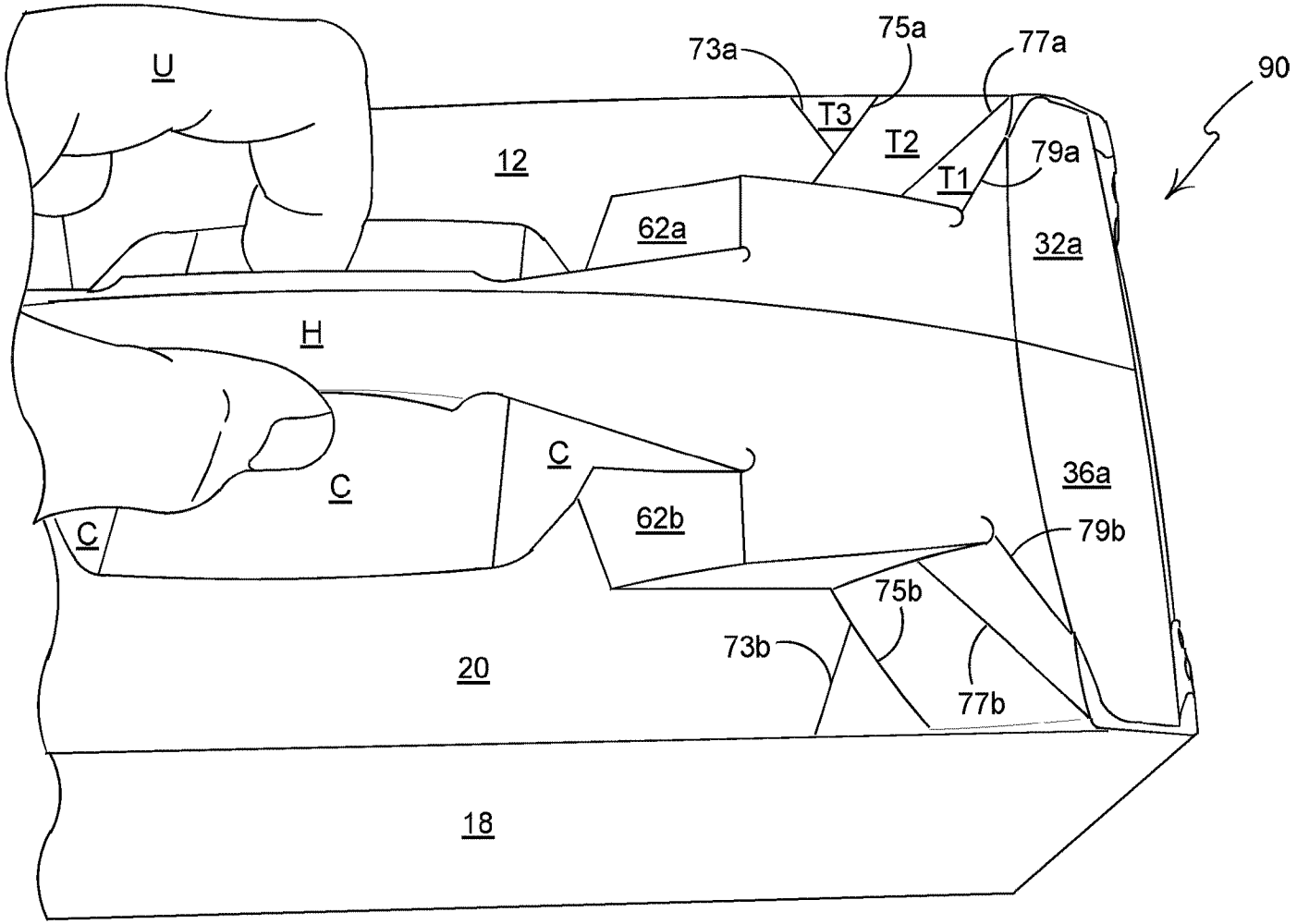
FIGS. 5 and 6 are perspective views of an end of a carton formed from the blank of FIG. 1 showing a carrying handle in use.
Figure 6:
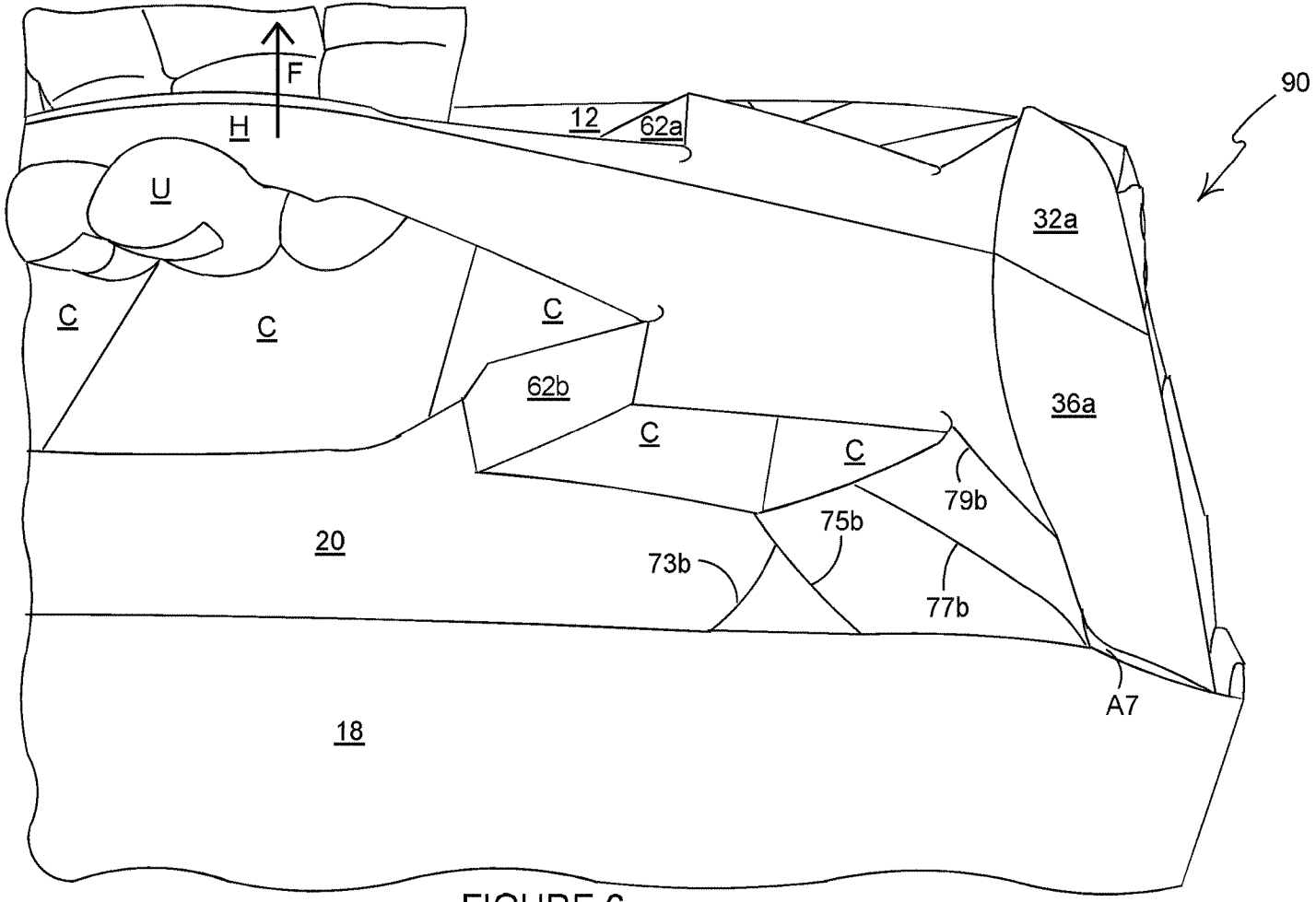

FIGS. 2 and 3 illustrate the transverse alignment of cans C with respect to the handle structure H of the carton 90 in accordance with a preferred embodiment of the invention. FIGS. 5 and 6 depict the manner in which the top wall of the carton 90, including its handle structure, bows upwardly when a force F is applied to lift a strap member S by a user U.

The blank 10 comprises a plurality of main panels 12, 14, 16, 18, 20 hinged one to the next in a linear series. The first blank 10 comprises a first top panel 12 hinged to a first side panel 14 by a fold line 11. The first side panel 14 is hinged to a base panel 16 by a fold line 13. The base panel 16 is hinged to a second side panel 18 by a fold line 15. The second panel 18 is hinged to a second top panel 20 by a fold line 17.

The plurality of main panels 12, 14, 16, 18, 20 of the first blank 10 forms an open ended tubular structure when in a set up condition.

Each of the ends of the tubular structure is at least partially closed by end closure panels. In the illustrated embodiment the ends of the tubular structure are fully closed by end closure panels 22*a*, 24*a*, 26*a*, 28*a*, 30*a*, 22*b*, 24*b*, 26*b*, 28*b*, 30*b*.

End closure panels 22*a*, 24*a*, 26*a*, 28*a*, 30*a* are configured to close a first end of the tubular structure and end panels 22*b*, 24*b*, 26*b*, 28*b*, 30*b* are configured to close a second end of the tubular structure.

A first end closure panel 22*a* is hinged to a first end of the first top panel 12 by a pair of fold lines 21*a*, 21*b*. A second end closure panel 24*a* is hinged to a first end of the first side panel 14 by a fold line 23*a*. A third end closure panel 26*a* is hinged to a first end of base panel 16 by a pair of fold lines 25*a*, 25*b*. A fourth end closure panel 28*a* is hinged to a first end of the second side panel 18 by a fold line 27*a*. A fifth end closure panel 30*a* is hinged to a first end of second top panel 20 by a pair of fold lines 29*a*, 29*b*.

The pair of fold lines 21*a*, 21*b* define a first corner panel or bevel panel 32*a* disposed between the first top panel 12 and the first end closure panel 22*a*.

The pair of fold lines 29*a*, 29*b* define a second corner panel or bevel panel 36*a* disposed between the second top panel 20 and the fifth end closure panel 30*a*. Together the first corner panel 32*a* and the second corner panel 36*a* form a composite corner panel 32*a*/36*a* at a first upper end of the carton 90.

The pair of fold lines 25*a*, 25*b* define a third corner panel 34*a* disposed between the base panel 16 and the third end closure panel 26*a*.

A sixth end closure panel 22*b* is hinged to a second end of the first top panel 12 by a pair of fold lines 21*c*, 21*d*. A seventh end closure panel 24*b* is hinged to a second end of first side panel 14 by a fold line 23*b*. An eighth end closure panel 26*b* is hinged to a second end of base panel 16 by a pair of fold lines 25*c*, 25*d*. A ninth end closure panel 28*b* is hinged to a second end of second side panel 18 by a fold line 27*b*. A tenth end closure panel 30*b* is hinged to a second end of second top panel 20 by a pair of fold lines 29*c*, 29*d*.

The pair of fold lines 21*c*, 21*d* define a fourth corner panel 32*b* disposed between the first top panel 12 and the sixth end closure panel 22*b*.

The pair of fold lines 29*c*, 29*d* define a fifth corner panel 36*b* disposed between the second top panel 20 and the tenth end closure panel 30*b*. Together the fourth corner panel 32*b* and the fifth corner panel 36*b* form a composite corner panel 32*b*/36*b* at a second upper end of the carton 90.

The pair of fold lines 25*c*, 25*d* define a sixth corner panel 34*b* disposed between the base panel 16 and the eighth end closure panel 26*b*.

The first end closure panel 22*a* and the fifth end closure panel 30*a* together form a minor side end closure panel. The third end closure panel 26*a* forms a minor side end closure panel. The sixth end closure panel 22*b* and the tenth end closure panel 30*b* together form a minor side end closure panel. The eighth end closure panel 26*b* forms a minor side end closure panel.

The second end closure panel 24*a* and the fourth end closure panel 28*a* each form a major upper end closure panel. The seventh end closure panel 24*b* and the ninth end closure panel 28*b* each form a major lower end closure panel.

A first web panel 38*a* couples the first end closure panel 22*a* to the second end closure panel 24*a*. The first web panel 38*a* is hinged to the first end closure panel 22*a* by a fold line 39*a*. The first web panel 38*a* is hinged to the second end closure panel 24*a* by a fold line 41*a*.

A second web panel 40*a* couples the second end closure panel 24*a* to the third end closure panel 26*a*. The second web panel 40*a* is hinged to the second end closure panel 24*a* by a fold line 43*a*. The second web panel 40*a* is hinged to the third end closure panel 26*a* by a fold line 45*a*.

A third web panel 42*a* couples the third end closure panel 26*a* to the fourth end closure panel 28*a*. The third web panel 42*a* is hinged to the third end closure panel 26*a* by a fold line 47*a*. The third web panel 42*a* is hinged to the fourth end closure panel 28*a* by a fold line 49*a*.

A fourth web panel 44*a* couples the fourth end closure panel 28*a* to the fifth end closure panel 30*a*. The fourth web panel 44*a* is hinged to the fourth end closure panel 28*a* by a fold line 51*a*. The fourth web panel 44*a* is hinged to the fifth end closure panel 30*a* by a fold line 53*a*.

A fifth web panel 38*b* couples the sixth end closure panel 22*b* to the seventh end closure panel 24*b*. The fifth web panel 38*b* is hinged to the sixth end closure panel 22*b* by a fold line 39*b*. The fifth web panel 38*b* is hinged to the seventh end closure panel 24*b* by a fold line 41*b*.

A sixth web panel 40*b* couples the seventh end closure panel 24*b* to the eighth end closure panel 26*b*. The sixth web panel 40*b* is hinged to the seventh end closure panel 24*b* by a fold line 43*b*. The sixth web panel 40*b* is hinged to the eighth end closure panel 26*b* by a fold line 45*b*.

A seventh web panel 42*b* couples the eighth end closure panel 26*b* to the ninth end closure panel 28*b*. The seventh web panel 42*b* is hinged to the eighth end closure panel 26*b* by a fold line 47*b*. The seventh web panel 42*b* is hinged to the ninth end closure panel 28*b* by a fold line 49*b*.

An eighth web panel 44*b* couples the ninth end closure panel 28*b* to the tenth end closure panel 30*b*. The eighth web panel 44*b* is hinged to the ninth end closure panel 28*b* by a fold line 51*b*. The eighth web panel 44*b* is hinged to the tenth end closure panel 30*b* by a fold line 53*b*.

The blank 10 comprises a first aperture A1, first aperture A1 is defined in part by the first top panel 12, the first side panel 14, the first corner panel 32*a*, the first end closure panel 22*a*, the first web panel 38*a* and the second end closure panel 24*a*.

The blank 10 comprises a second aperture A2, second aperture A2 is defined in part by the first top panel 12, the first side panel 14, the fourth corner panel 32*b*, the sixth end closure panel 22*b*, the fifth web panel 38*b* and the seventh end closure panel 24*b*.

The blank 10 comprises a third aperture A3, third aperture A3 is defined in part by the base panel 16, the first side panel 14, the third corner panel 34*a*, the third end closure panel 26*a*, the second web panel 40*a* and the second end closure panel 24*a*.

The blank 10 comprises a fourth aperture A4, fourth aperture A4 is defined in part by the base panel 16, the first side panel 14, the sixth corner panel 34*b*, the eighth end closure panel 26*b*, the sixth web panel 40*b* and the seventh end closure panel 24*b*.

The blank 10 comprises a fifth aperture A5, fifth aperture A5 is defined in part by the base panel 16, the second side panel 18, the third corner panel 34*a*, the third end closure panel 26*a*, the third web panel 42*a* and the fourth end closure panel 28*a*.

The blank 10 comprises a sixth aperture A6, sixth aperture A6 is defined in part by the base panel 16, the second side panel 18, the sixth corner panel 34*b*, the eighth end closure panel 26*b*, the seventh web panel 42*b* and the ninth end closure panel 28*b*.

The blank 10 comprises a seventh aperture A7 seventh aperture A7 is defined in part by the second top panel 20, the second side panel 18, the second corner panel 36*a*, the fifth end closure panel 30*a*, the fourth web panel 44*a* and the fourth end closure panel 28*a*.

The blank 10 comprises an eighth aperture A8, eighth aperture A8 is defined in part by the second top panel 20, the second side panel 18, the fifth corner panel 36*b*, the tenth end closure panel 30*b*, the sixth web panel 44*b* and the ninth end closure panel 28*b*.

The blank 10 comprises a first handle structure HA1 in the first top panel 12 and a second handle structure HA2 in the second top panel 20.

The blank 10 comprises an access device struck in part from the base panel 16 and in part from the second side panel 18. The access device 50 comprises a gate panel 52.

The gate panel 52 is defined by a first severance line 54*a*, a second severance line 54*b*, a third severance line 54*c* and a tear initiation device 50.

In alternative embodiments the gate panel 52 is hinged to the carton 90, for example by a hinge line, in replacement of a second severance line 54*b*.

The second severance line 54*b* is defined in the second side panel 18.

The first severance line 54*a* extends from a first end of the second severance line 54*b* into the base panel 16 to a first end of the tear initiation device 50. The third severance line 54*c* extends from a second end of the second severance line 54*b* into the base panel 16 to a second end of the tear initiation device 50.

In this way, the first severance line 54*a*, the second severance line 54*b*, the third severance line 54*c* and the tear initiation device 50 form a continuous loop.

The tear initiation device 50 comprises pair of tabs 56*a*, 56*b* defined by a substantially "m" shaped severance line 58 and a pair of fold lines 59*a*, 59*b*. The "m" shaped severance line 58 extends between a second end of the first severance line 54*a* and a second end of the third severance line 54*c*. A first fold line 59*a* extends from a first end of the "m" shaped severance line 58 to the centre of the "m" shaped severance line 58. A second fold line 59*b* extends from a second end of the "m" shaped severance line 58 to the centre of the "m" shaped severance line 58. In this way two tabs 56*a*, 56*b* are formed which are hinged to the gate panel 52.

In alternative embodiments the tabs 56*a*, 56*b* may be hinged to the base panel 16.

The blank 10 comprises a handle structure; the handle structure is defined in part in the first top panel 12 and in part in the second top panel 20.

The first top panel 12 and the second top panel 20 form the top wall, or panel, of the carton 90 that contains the handle structure.

The first top panel 12 comprises a first portion H1 of the handle structure. The first portion H1 comprises a strap member with a tapered region mediate each of the end regions. The strap member is defined at least in part by a first handle aperture HA1 and a first severance line 61*a*, and a second severance line 63*a*. The handle structure comprises a cushioning flap 6 hinged to the strap member by a fold line 7, the cushioning flap 6 being defined at least in part by the first handle aperture HA1.

At each end region of the strap handle member a web extends diagonally from the vertex of a side edge and an end edge of the first top panel 12.

A first web, disposed at a first end of the strap member, comprises a plurality of fold lines 79*a*, 77*a*, 75*a*, 73*a* and a third severance line 65*a*. The third severance line 65*a* extends substantially longitudinally with respect to the first top panel 12. The third severance line 65*a* is spaced apart from the first severance line 61*a*. The third severance line 65*a* is arranged in a partially overlapping relationship with the first severance line 61*a*.

A connecting member 62*a* is defined in the region of the overlap between the third severance line 65*a* and the first severance line 61*a*. The connecting member 62*a* conjoins the strap member and a portion of the region of the first top panel 12 adjacent the strap member. The connecting member 62*a* is defined in part by a fold line 93*a* and a fold line 95*a*. Fold line 95*a* extends between the third severance line 65*a* and the first severance line 61*a*. Fold line 93*a* extends between the third severance line 65*a* and the first handle aperture HA1.

The web comprises a first fold line 79*a*, first fold line 79*a* extends between an end of the third severance line 65*a* and a first end edge of the first top panel 12 defined by the fold line 21*a*. The first fold line 79*a* terminates at the first aperture A1 at a point inset laterally from the side edge of the first top panel 12 defined by the fold line 11.

The first web comprises a second fold line 77*a*, second fold line 77*a* extends between the third severance line 65*a* and a first corner of the first top panel 12 defined by the first end edge (fold line 21*a*) and the side edge (fold line 11). The second fold line 77*a* terminates at the first aperture A1 at a point on the side edge of the first top panel 12.

The first fold line 79*a* and the second fold line 77*a* define in part a first trapezoidal portion of the first top panel 12. The first fold line 79*a* and the second fold line 77*a* are arranged to be convergent towards the first corner of the top panel 12.

The first web comprises a third fold line 75*a*, third fold line 75*a* extends between the third severance line 65*a* and a side edge of the first top panel 12 defined by the fold line 11 at a point inset longitudinally from the first corner of the top panel 12.

The third fold line 75*a* and the second fold line 77*a* define in part a second trapezoidal portion of the first top panel 12. The third fold line 75*a* and the second fold line 77*a* are arranged to be convergent towards the third severance line 65*a*.

The first web comprises a fourth fold line 73*a*, fourth fold line 73*a* extends between the third fold line 75*a* and a side edge of the first top panel 12 defined by the fold line 11 at a point inset longitudinally from the terminus of the third fold line 75*a* on the fold line 11. The third fold line 75*a* and the fourth fold line 73*a* define in part a triangular portion of the first top panel 12.

The first aperture A1 is substantially "boot" shaped, the "toe" of the "boot" extending into the first corner panel 32*a*, and the "shaft" of the "boot" extending substantially longitudinally. The "heel" of the "boot" lies substantially on the fold line 11 defining the side edge of the first top panel 12.

A second web, disposed at a second end of the strap member, comprises a plurality of fold lines 81*a*, 83*a*, 85*a*, 87*a* and a fourth severance line 67*a*. The fourth severance line 67*a* extends substantially longitudinally with respect to the first top panel 12. The fourth severance line 67*a* is spaced apart from the second severance line 63*a*. The fourth severance line 67*a* is arranged in a partial overlapping relationship with the second severance line 63*a*.

A connecting member 64*a* is defined in the region of the overlap between the fourth severance line 67*a* and the second severance line 63*a*. The connecting member 64*a* conjoins the strap member and a portion of the region of the first top panel 12 adjacent the strap member. The connecting member 64*a* is defined in part by a fold line 89*a* and a fold line 91*a*. Fold line 89*a* extends between the fourth severance line 67*a* and the second severance line 63*a*. Fold line 91*a* extends between the fourth severance line 67*a* and the first handle aperture HA1.

The second web comprises a first fold line 81*a*, first fold line 81*a* extends between an end of the fourth severance line 67*a* and a second end edge of the first top panel 12 defined by the fold line 21*c*. The first fold line 81*a* terminates at the second aperture A2 at point inset laterally from the side edge of the first top panel 12 defined by the fold line 11.

The second web comprises a second fold line 83*a*, second fold line 83*a* extends between the fourth severance line 67*a* to a second corner of the first top panel 12 defined by the second end edge (fold line 21*c*) and the side edge (fold line 11). The second fold line 83*a* terminates at the second aperture A2 at point on the side edge of the first top panel 12.

The first fold line 81*a* and the second fold line 83*a* define in part a first trapezoidal portion of the first top panel 12. The first fold line 81*a* and the second fold line 83*a* are arranged to be convergent towards the second corner of the top panel 12.

The second web comprises a third fold line 85*a*, third fold line 85*a* extends between the fourth severance line 67*a* and a side edge of the first top panel 12 defined by the fold line 11 at a point inset longitudinally from the second corner of the top panel 12.

The third fold line 85*a* and the second fold line 83*a* define in part a second trapezoidal portion of the first top panel 12. The third fold line 85*a* and the second fold line 83*a* are arranged to be convergent towards the fourth severance line 67*a*.

The second web comprises a fourth fold line 87*a*, fourth fold line 87*a* extends between the third fold line 85*a* and a side edge of the first top panel 12 defined by the fold line 11 at a point inset longitudinally from the terminus of the third fold line 85*a* on the fold line 11. The third fold line 85*a* and the fourth fold line 87*a* define in part a triangular portion of the first top panel 12.

The second aperture A2 is substantially "boot" shaped, the "toe" of the "boot" extending into the fourth corner panel 32*b*, and the "shaft" of the "boot" extending substantially longitudinally. The "heel" of the "boot" lies substantially on the fold line 11 defining the side edge of the first top panel 12.

The second top panel 20 comprises a second portion H2 of the handle structure, the second portion H2 comprises a strap member with a tapered region mediate each of the end regions. The strap member is defined at least in part by a second handle aperture HA2 and a first severance line 61*b* and a second severance line 63*b*. The handle structure comprises a cushioning flap 8 hinged to the strap member by a fold line 9, the cushioning flap 8 being defined at least in part by the second handle aperture HA2.

At each end region of the strap handle member a web extends diagonally from the vertex of a side edge and an end edge of the second top panel 20.

A first web, disposed at a first end of the strap member, comprises a plurality of fold lines 79*b*, 77*b*, 75*b*, 73*b* and a third severance line 65*b*. The third severance line 65*b* extends substantially longitudinally with respect to the second top panel 20. The third severance line 65*b* is spaced apart from the first severance line 61*b*. The third severance line 65*b* is arranged in a partial overlapping relationship with from the first severance line 61*b*.

A connecting member 62*b* is defined in the region of the overlap between the third severance line 65*b* and the first severance line 61*b*. The connecting member 62*b* conjoins the strap member and a portion of the region of the second top panel 20 adjacent the strap member. The connecting member 62*b* is defined in part by a fold line 93*b* and a fold line 95*b*. Fold line 95*b* extends between the third severance line 65*b* and the first severance line 61*b*. Fold line 93*b* extends between the third severance line 65*b* and the second handle aperture HA2.

The web comprises a first fold line 79*b*, first fold line 79*b* extends between an end of the third severance line 65*b* and a first end edge of the second top panel 20 defined by the fold line 29*a*. The first fold line 79*b* terminates at the seventh aperture A7 at point inset laterally from the side edge of the second top panel 20 defined by the fold line 17.

The first web comprises a second fold line 77*b*. Second fold line 77*b* extends between the third severance line 65*b* to a first corner of the second top panel 20 defined by the first end edge (fold line 29*a*) and the side edge (fold line 17). The second fold line 77*b* terminates at the seventh aperture A7 at point on the side edge of the second top panel 20.

The first fold line 79*b* and the second fold line 77*b* define in part a first trapezoidal portion of the second top panel 20. The first fold line 79*b* and the second fold line 77*b* are arranged to be convergent towards the first corner of the second top panel 20.

The first web comprises a third fold line 75*b*, third fold line 75*b* extends between the third severance line 65*b* and a side edge of the second top panel 20 defined by the fold line 17 at a point inset longitudinally from the first corner of the second top panel 20.

The third fold line 75*b* and the second fold line 77*b* define in part a second trapezoidal portion of the second top panel 20. The third fold line 75*b* and the second fold line 77*b* are arranged to be convergent towards the third severance line 65*b*.

The first web comprises a fourth fold line 73*b*, fourth fold line 73*b* extends between the third fold line 75*b* and a side edge of the second top panel 20 defined by the fold line 17 at a point inset longitudinally from the terminus of the third fold line 75*b* on the fold line 17. The third fold line 75*b* and the fourth fold line 73*b* define in part a triangular portion of the second top panel 20.

The seventh aperture A7 is substantially "boot" shaped, the "toe" of the "boot" extending into the second corner panel 36*a*, and the "shaft" of the "boot" extending substantially longitudinally. The "heel" of the "boot" lies substantially on the fold line 17 defining the side edge of the second top panel 20.

A second web, disposed at a second end of the strap member, comprises a plurality of fold lines 81*b*, 83*b*, 85*b*, 87*b* and a fourth severance line 67*b*. The fourth severance line 67*b* extends substantially longitudinally with respect to the second top panel 20. The fourth severance line 67*b* is spaced apart from the second severance line 63*b*. The fourth severance line 67*b* is arranged in a partial overlapping relationship with from the second severance line 63*b*.

A connecting member 64*b* is defined in the region of the overlap between the fourth severance line 67*b* and the second severance line 63*b*. The connecting member 64*b* conjoins the strap member and a portion of the region of the second top panel 20 adjacent the strap member. The connecting member 64*b* is defined in part by a fold line 89*b* and a fold line 91*b*. Fold line 89*b* extends between the fourth severance line 67*b* and the second severance line 63*b*. Fold line 91*b* extends between the fourth severance line 67*b* and the second handle aperture HA2.

The second web comprises a first fold line 81*b*, first fold line 81*b* extends between an end of the fourth severance line 67*b* and a second end edge of the second top panel 20 defined by the fold line 29*c*. The first fold line 81*b* terminates at the eighth aperture A8 at point inset laterally from the side edge of the second top panel 20 defined by the fold line 17.

The second web comprises a second fold line 83*b*, second fold line 83*b* extends between the fourth severance line 67*b* to a second corner of the second top panel 20 defined by the second end edge (fold line 29*c*) and the side edge (fold line 17). The second fold line 83*b* terminates at the eighth aperture A8 at point on the side edge of the second top panel 20.

The first fold line 81*b* and the second fold line 83*b* define in part a first trapezoidal portion T1 of the second top panel 20. The first fold line 81*b* and the second fold line 83*b* are arranged to be convergent towards the second corner of the second top panel 20.

The second web comprises a third fold line 85*b*, third fold line 85*b* extends between the fourth severance line 67*b* and a side edge of the second top panel 20 defined by the fold line 17 at a point inset longitudinally from the second corner of the second top panel 20.

The third fold line 85*b* and the second fold line 83*b* define in part a second trapezoidal portion T2 of the second top panel 20. The third fold line 85*b* and the second fold line 83*b* are arranged to be convergent towards the fourth severance line 67*b*.

The second web comprises a fourth fold line 87*b*, fourth fold line 87*b* extends between the third fold line 85*b* and a side edge of the second top panel 20 defined by the fold line 17 at a point inset longitudinally from the terminus of the third fold line 85*b* on the fold line 17. The third fold line 85*b* and the fourth fold line 87*b* define in part a triangular portion T3 of the second top panel 20.

The eighth aperture A8 is substantially "boot" shaped, the "toe" of the "boot" extending into the fifth corner panel 36*b*, and the "shaft" of the "boot" extending substantially longitudinally. The "heel" of the "boot" lies substantially on the fold line 17 defining the side edge of the second top panel 20.

Stress upon the end regions of the handle structure is more evenly directed toward the ends of the handle structure and the carton 90 through the webs.

In the erected carton 90, the strap member of the first top panel 12 and the strap member of the second top panel 20 overlap, at least partially, and the tapered regions overlap at least partially, to produce a substantially reinforced handle.

The strap member S of the carrying handle H provides a structure that directs stress towards the ends of the carton 90. The features of the handle structure which are described above cause the strap S and other elements upon the composite top panel 12/20 of the carton 90 to flex, or bow, in an outwardly-projecting predetermined manner when the carton 90 is lifted F by a user U, as shown in FIGS. 5 and 6. The structure of the webs causes the composite top panel 12/20 of the carton 90 to concavely bow in a stepped configuration, ascending inwardly, when the carton is lifted by a force, as illustrated in FIG. 6. The connecting tabs 62*a*, 62*b*, 64*a*, 64*b* interconnect the strap S and adjacent regions of the composite top panel 12/20. This interconnection causes the composite top panel 12/20 to maintain a more contiguous configuration when the carton 90 is lifted. The side regions of the composite top panel 12/20 have a tendency to flex away from the strap S. The connecting tabs 62*a*, 62*b*, 64*a*, 64*b* inhibit such movement and promote a more pleasing appearance and greater integrity of the composite top panel 12/20.

The corner panels 32*a*, 32*b*, 34*a*, 34*b*, 36*a*, 36*b* enable the corners of the carton 90 to be drawn tighter when cans C or similar articles are transversely aligned in the carton 90 with respect to the lengthwise dimension of the carton 90 and composite top panel 12/20, as shown in FIGS. 5 and 6.

The first aperture A1, second aperture A2, seventh aperture A7 and eighth aperture A8 facilitate the inward movement of the corner panels 32*a*, 32*b*, 36*a*, 36*b*. In use the first aperture A1, second aperture A2, seventh aperture A7 and eighth aperture A8 each close up as can be seen by comparison of FIG. 6 to FIG. 4. In this way the ends of the handle structure are braced upon the endmost articles in the uppermost row of the carton 90.

The structure of the invention provides a handle that is reinforced and that directs stress away from the handle itself to the ends of the carton while helping the carton to maintain an aesthetically pleasing appearance and greater integrity when lifted.

The "toe" portion of each of the first, second, seventh and eighth apertures A1, A2, A7, A8 forms a cutaway between the end portions of the first, second, fourth and fifth corner panels 32*a*, 32*b*, 36*a*, 36*b* and the handle panel formed by the composite top panel 12/20. In alternative embodiments the cutaway may be formed from a slit or slot.

Turning to the construction of the carton 90 as illustrated in FIGS. 2 to 6, it is envisaged that the carton 90 can be formed by a series of sequential folding operations in a straight line machine so that the carton 90 is not required to be rotated or inverted to complete its construction. The folding process is not limited to that described below and may be altered according to particular manufacturing requirements.

The blank 10 is folded about fold line 13, such that the first top panel 12 and first side panel 14 are folded thereabouts. The first top panel 12 is brought into face contacting relationship with the second side panel 18; the first side panel 14 is brought into face contacting relationship with the base panel 16 and a portion of the second side panel 18.

Glue or other adhesive treatment is applied to the first top panel 12 or, in alternative embodiments, to a corresponding portion of the second top panel 20.

The second top panel 20 is folded about the fold line 17 such that the second top panel 20 overlies a portion of the first top panel 12.

The second top panel 20 is secured to the first top panel 12 to form a flat collapsed carton. The carton may be shipped or distributed in this flat collapsed form.

In alternative embodiments the second top panel 20 may be secured to the first top panel 12 by alternative securing means for example, but not limited to, staples or other mechanical fixing means.

The flat collapsed carton may be erected into a tubular structure by separating the composite top panel 12/20 from the base panel 16.

The carton 90, in its open ended tubular form, may be loaded with articles C through one or both open ends. It will be appreciated that in other embodiments one of the open ends of the carton 90 may be closed before loading the carton 90 with articles C through the remaining open end.

Once the carton 90 is loaded with articles C the ends of the tubular structure are closed.

A first end of the tubular structure is closed by folding the first and fifth end closure panels 22*a*, 30*a* about fold lines 21*b*, 29*b* respectively and by folding the third end closure panel 26*a* about fold line 25*b*.

Glue or other adhesive treatment is applied to an outer surface of the second end closure panel 24*a*, or in alternative embodiments to an inner surface of the fourth end closure panel 28*a*.

Folding the first and fifth end closure panels 22*a*, 30*a* about fold lines 21*b*, 29*b* and the third end closure panel 26*a* about fold line 25*b* has the effect of automatically at least partially folding the second end closure panel 24*a* and the fourth end closure panel 28*a* about fold lines 23*a*, 27*a* respectively.

The second end closure panel 24*a* is then folded about the fold line 23*a* to be brought into contact with the first and fifth end closure panels 22*a*, 30*a* and the third end closure panel 26*a* and is preferably secured thereto.

The fourth end closure panel 28*a* is then folded about the fold line 27*a* to be brought into contact with at least the second end closure panel 24*a* and is secured thereto.

A second end of the tubular structure is closed by folding the sixth, seventh, eighth, ninth and tenth end closure panels 22*b*, 24*b*, 26*b*, 28*b*, 30*b* in a manner substantially similar to that described above in relation to the first end of the carton 90.

The primary elements of the handle structure of the subject invention are the strap member S, disjoined from the handle panel 12/20, and what are referred to in this portion of the description as severance line segments 65*a*, 65*b*, 67*a*, 67*b*. Each severance line segment extends between one point that is close to a corner of the handle panel and a second point that is close to a centrally disposed grip region of the strap member. This arrangement produces a spring like relationship between the strap member S and the handle panel 12/20 such that when a force F is exerted upon the grip region of the carrying handle in a direction substantially perpendicular to a plane (or notional plane) in which the handle panel 12/20 lies, the strap member S flexes outwardly of the plane to a biased position above the plane, as illustrated in FIGS. 5 and 6. The arrangement of elements just described essentially creates a structure which conjoins end regions of the strap member S with the remainder of the handle panel 12/20. Stress due to the weight of the carton 90 and its contents (and the offsetting force F used to lift and suspend the carton 90) is focused from the ends of the strap member towards the corners and end walls and adjacent side wall regions of the carton 90 instead of at undesirable regions of the handle panel and the grip region of the strap member that may tear or fail. The substantial separation of the grip region of the strap member from the plane of the handle panel helps facilitate dissipation of stress in the manner described above. The "toe" portion of each of the first, second, seventh and eighth apertures A1, A2, A7, A8 forms a cutaway between the end portions of the first, second, fourth and fifth corner panels 32*a*, 32*b*, 36*a*, 36*b* and the handle panel formed by composite top panel 12/20. The first aperture A1, second aperture A2, seventh aperture A7 and eighth aperture A8 facilitate the inward movement of the corner panels 32*a*, 32*b*, 36*a*, 36*b*. In use the first aperture A1, second aperture A2, seventh aperture A7 and eighth aperture A8 each close up, as can be seen by comparison of FIG. 6 to FIG. 4. In this way the ends of the handle structure are braced upon the endmost articles in the uppermost row of the carton 90. Providing the carton 90 with the corner panels 32*a*, 32*b*, 36*a*, 36*b* allows the carton to be disposed in closer proximity to the endmost articles disposed adjacent thereto. In this way less displacement of the carton 90 is required to brace the carton 90 against the adjacent articles. This further facilitates tightening of the carton 90 about the articles C. The uppermost row of articles tightens against one another to form a brace or strut within the carton 90 between the ends of the carton 90.

It can be appreciated that various changes may be made within the scope of the present invention. For example, the size and shape of the panels and apertures may be adjusted to accommodate articles of differing size or shape. For example the fold lines 21*a*, 21*b*, 21*c*, 21*d*, 25*a*, 25*b*, 25*c*, 25*d*, 29*a*, 29*b*, 29*c*, 29*d* may be linear rather than the arcuate shape shown in the Figures. In some embodiments the fold lines 21*a*, 21*b*, 21*c*, 21*d*, 25*a*, 25*b*, 25*c*, 25*d*, 29*a*, 29*b*, 29*c*, 29*d* may be non-linear, formed from two or more linear sections.

It will be recognised that as used herein, directional references such as "top", "bottom", "front", "back", "rear", "end", "side", "inner", "outer", "upper" and "lower" do not necessarily limit the respective panels to such orientation, but may merely serve to distinguish these panels from one another.

As used herein, the term "hinged" refers to all manner of connections provided by one or more fold lines that define hinge features of the blank or substrate of sheet material. Such one or more fold lines facilitate folding portions of the blank or substrate of sheet material with respect to one another, or otherwise indicate optimal panel folding locations for the blank or substrate of sheet material. Any reference to "hinged" should not be construed as necessarily referring to a connection provided by a single fold line only; indeed "hinged" may refer to a connection formed from two or more fold lines.

The term "fold line" as used herein refers to any line that defines a hinge line in a foldable sheet material, such as paperboard, for facilitating folding of portions of a blank of sheet material with respect to one another, or otherwise indicating optimal panel folding locations on the blank. A fold line may be formed by a single score, a single half cut, a line of perforations, a line of cuts, a line of short slits, a line of half cuts, a line of scores, any combination thereof, or the like.

The terms "severance line" and "severance line segment" as used herein each refers to any line that defines a separation line in a foldable sheet material, such as paperboard, for facilitating separation of portions of a blank of sheet material from one another, or otherwise indicating optimal separation locations on the blank. A severance line and severance line segment each may be formed by a single cut, a single half cut, a line of perforations, a line of cuts, a line of short slits, a line of half cuts, any combination thereof, or the like.

It should be understood that the elements of a fold line or severance line, such as cuts, scores, half cuts, slits, perforations or the like, may be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The invention claimed is:

1. A carton comprising:

a plurality of main panels hinged one to the next to form a tubular structure, the plurality of main panels including a handle panel having first and second opposing end edges and opposing side edges which intersect each other to form corners of the handle panel;

a plurality of end closure panels for at least partially closing an end of the tubular structure, the plurality of end closure panels including a first end closure panel;

a first corner panel hinged to the handle panel at the first end edge along a first end edge fold line, the first corner panel hinged to the first end closure panel along a corner panel fold line such that the first corner panel is defined between the handle panel and the first end closure panel;

wherein the handle panel comprises a handle structure for carrying the carton, the handle structure comprising:

a strap member integrally conjoined with the handle panel and extending substantially between the end edges, the strap member having opposing strap edges substantially disjoined from the handle panel, the strap member including a substantially centrally disposed grip region; and a respective severance line segment disposed proximate each of the corners of the handle panel and extending from a first end point proximate a respective one of the corners to a second end point proximate the grip region of the strap member;

the carton further comprising:

a first cutaway separating the first corner panel from a first one of the corners of the handle panel; and a second cutaway separating the first corner panel from a second one of the corners of the handle panel;

such that when a force substantially normal to a plane of the handle panel is exerted upon the grip region, the first and second cutaways facilitate displacement of the first corner panel towards the first end edge of the handle panel whereby the strap member is encouraged to flex substantially outwardly of the plane to a biased position above the plane.

2. The carton of claim 1, further comprising a second corner panel hinged to the handle panel at the second end edge, a third cutaway separating the second corner panel from a third one of the corners of the handle panel, and a fourth cutaway separating the second corner panel from a fourth one of the corners of the handle panel, such that when a force substantially normal to the plane of the handle panel is exerted upon the grip region, the third and fourth cutaways facilitate displacement of the second corner panel towards the second end edge of the handle panel whereby the strap member is encouraged to flex substantially outwardly of the plane to said biased position.

3. The carton of claim 2, wherein the handle structure further comprises a pair of first and second fold lines extending from each of the severance line segments and converging towards an adjacent one of the corners of the handle panel.

4. The carton of claim 3, further comprising a first trapezoidal portion disposed adjacent to each of the corners of the handle panel, each of the first trapezoidal portions being defined in part by a respective one of the pairs of first and second fold lines.

5. The carton of claim 4, wherein each of the first trapezoidal portions is defined in part by a respective one of the first, second, third and fourth cutaways.

6. The carton of claim 5, wherein an end edge of each of the first trapezoidal portions is defined by the respective one of the first, second, third and fourth cutaways.

7. The carton of claim 4, further comprising a second trapezoidal portion disposed between each of the severance line segments and an adjacent one of the side edges of the handle panel, each of the second trapezoidal portions being disposed adjacent to a respective one of the first trapezoidal portions and being defined in part by a third fold line and the second fold line of the respective one of the first trapezoidal portions, the third and second fold lines of each of the second portions extend divergently towards an adjacent one of the side edges of the handle panel.

8. The carton of claim 7, further comprising a triangular portion disposed adjacent to each of the second trapezoidal portions, each of the triangular portions is defined in part by a fourth fold line and the third fold line of a respective one of the second trapezoidal portions, the third and fourth fold lines of each of the triangular portions extend divergently towards an adjacent one of the side edges of the handle panel, and wherein the fourth fold line of each of the triangular portions terminates on the third fold line of the each triangular portion.

9. The carton of claim 1, wherein the grip region is defined at least in part by respective segments of the opposing strap edges of the strap member, the respective segments being substantially parallel to the opposing side edges of the handle panel.

10. A blank for forming a carton comprising a plurality of panels for forming walls of the carton, the blank comprising:

a plurality of main panels hinged one to the next to form a tubular structure in a set-up carton, the plurality of main panels including a handle panel forming one of the walls of the carton, the handle panel having first and second opposing end edges and opposing side edges that intersect to form corners of the handle panel;

a plurality of end closure panels for at least partially closing an end of the tubular structure, the plurality of end closure panels including a first end closure panel;

a first corner panel hinged to the handle panel at the first end edge along a first end edge fold line, the first corner panel hinged to the first end closure panel along a corner panel fold line such that the first corner panel is defined between the handle panel and the first end closure panel;

wherein the handle panel comprises a handle structure for carrying the carton in a set up condition, the handle structure comprising:

a strap member integrally conjoined with the handle panel and extending substantially between the end edges, the strap member having opposing strap edges substantially disjoined from the handle panel, the strap member including a substantially centrally disposed grip region; and a respective severance line segment disposed proximate each of the corners of the handle panel and extending from a first end point proximate a respective one of the corners to a second end point proximate the grip region of the strap member;

the blank further comprising:

a first cutaway separating the first corner panel from a first one of the corners of the handle panel; and a second cutaway separating the first corner panel from a second one of the corners of the handle panel;

such that in a set up carton when a force is exerted upon the grip region substantially normally to a plane of the handle panels, the first and second cutaways facilitate displacement of the first corner panel towards the first end edge of the handle panel to encourage the strap member to flex substantially outwardly of the plane to a biased position above the plane.

11. The blank of claim 10, further comprising a second corner panel hinged to the handle panel at the second end edge, a third cutaway separating the second corner panel from a third one of the corners of the handle panel, and a fourth cutaway separating the second corner panel from a fourth one of the corners of the handle panel, such that in a set up condition when a force substantially normal to the plane of the handle panel is exerted upon the grip region, the third and fourth cutaways facilitate displacement of the second corner panel towards the second end edge of the handle panel whereby the strap member is encouraged to flex substantially outwardly of the plane.

12. The blank of claim 11, wherein each of the first, second, third and fourth cutaways is formed by an aperture.

13. The blank of claim 12, wherein each of the apertures is defined in part by the handle panel, a respective one of the corner panels, a side panel hinged to the handle panel, a minor end closure panel hinged to the corner panel and a web panel coupling the minor end closure panel to a major end closure panel hinged to the side panel.

14. A handle structure for a carton having a handle panel with opposing side edges and opposing end edges that intersect to form corners of the handle panel, the handle structure comprising:

a strap member integrally conjoined with the handle panel and extending substantially between the end edges, the strap member having opposing strap edges substantially disjoined from the handle panel, the strap member including a substantially centrally disposed grip region; and a respective severance line segment disposed proximate each of the corners of the handle panel and extending from a first end point proximate a respective one of the corners of the handle panel to a second end point proximate the grip region of the strap member;

such that when a force substantially normal to a plane of the handle panel is exerted upon the grip region, the strap member is flexed substantially outwardly of the plane to a biased position above the plane;

the handle structure further comprising a pair of first and second fold lines extending from each of the severance line segments and converging towards an adjacent one of the corners of the handle panel;

the handle structure further comprising a first trapezoidal portion disposed adjacent to each of the corners of the handle panel, each of the first trapezoidal portions being defined in part by a respective one of the pairs of first and second fold lines; and a second trapezoidal portion disposed between each of the severance line segments and an adjacent one of the side edges of the handle panel, each of the second trapezoidal portions being disposed adjacent to a respective one of the first trapezoidal portions and being defined in part by a third fold line and the second fold line of the respective one of the first trapezoidal portions, the third and second fold lines of each of the second portions extend divergently towards an adjacent one of the side edges of the handle panel.

15. The handle structure of claim 14, wherein the grip region is defined at least in part by respective segments of the opposing strap edges of the strap member, the respective segments being substantially parallel to the opposing side edges of the handle panel.

16. The handle structure of claim 14, wherein the first fold line of each pair extends from an outer end of a respective one of the severance line segments to a point on an adjacent one of the end edges of the handle panel laterally inset from an adjacent one of the side edges of the handle panel.

17. The handle structure of claim 14, wherein the second fold line of each pair extends from an adjacent one of the corners of the handle panel to a location on an adjacent one of the severance line segments inset from an outer end of the adjacent one of the severance line segments.

18. The handle structure of claim 14, further comprising a triangular portion disposed adjacent to each of the second trapezoidal portions, each of the triangular portions is defined in part by a fourth fold line and the third fold line of a respective one of the second trapezoidal portions, the third and fourth fold lines of each of the triangular portions extend divergently towards an adjacent one of the side edges of the handle panel, and wherein the fourth fold line of each of the triangular portions terminates on the third fold line of the each triangular portion.

* * * * *